United States Patent [19]

Naito

[11] Patent Number: 5,017,894

[45] Date of Patent: May 21, 1991

[54] LUMPED CONSTANT NON-RECIPROCAL CIRCUIT ELEMENT

[75] Inventor: Norihiro Naito, Tottori, Japan

[73] Assignee: Hitachi Ferrite, Ltd., Tokyo, Japan

[21] Appl. No.: 460,802

[22] Filed: Jan. 4, 1990

[30] Foreign Application Priority Data

Feb. 1, 1989 [JP] Japan ..... 1-11686[U]
Sep. 13, 1989 [JP] Japan ..... 1-237660

[51] Int. Cl.[5] ..... H01P 1/383; H01P 1/36
[52] U.S. Cl. ..... 333/1.1; 333/24.2
[58] Field of Search ..... 333/1.1, 24.2

[56] References Cited

U.S. PATENT DOCUMENTS 4,812,787 3/1989 Kuramoto et al. ..... 333/1.1
4,855,694 8/1989 Ogawa ..... 333/1.1
4,904,965 2/1990 Blight et al. ..... 333/1.1

FOREIGN PATENT DOCUMENTS 3034034 3/1982 Fed. Rep. of Germany ..... 333/1.1
63-107203 5/1988 Japan .

*Primary Examiner*—Paul Gensler
*Attorney, Agent, or Firm*—Finnegan, Henderson, Farabow, Garrett & Dunner

[57] ABSTRACT

A lumped constant non-reciprocal circuit element includes an insulator substrate, a predetermined number of conductor layers formed on a top surface of the insulator substrate for forming electrostatic capacitors, a shielding conductor layer formed on a top surface of the insulator substrate, and a conductor layer formed on a bottom surface of the insulator substrate and electrically connected to the shielding conductor layer. A magnetic member is disposed on the shielding conductor layer formed on the insulator substrate, and a predetermined number of mutually insulated central conductors are disposed on the magnetic member such that one end of each central conductor is connected to the shielding conductor layer and the other portion of each central conductor is connected to each electrostatic capacitor-forming conductor layer. Also means are provided for applying a dc magnetic field to the magnetic member.

4 Claims, 8 Drawing Sheets

LUMPED CONSTANT NON-RECIPROCAL CIRCUIT ELEMENT

BACKGROUND OF THE INVENTION

The present invention relates to lumped constant non-reciprocal circuit elements such as circulators and isolators for use in VHF, UHF and microwave frequency bands.

A circulator can be converted into an isolator if one port is closed with a dummy resistor, and an isolator can be converted into a circulator if one port is used as a connection port for external networks. Namely, they are of the same structure, though they are called differently depending on how they are used. Thus, lumped constant circulators and isolators have the same technological basis. Hence, it should be noted that though isolators are explained mainly hereinafter, substantially the same explanations are applicable to circulators.

A typical prior art isolator is shown in FIG. 8. The isolator has three sets of central conductors 401 positioned between two garnet plates 402, 402 which are insulated from the conductors by means of an insulator, and these elements are covered with a shielding plate 403. They are placed in the central bore of a ceramic substrate 404 with one end of each conductor 401 connected to a corresponding electrode [not shown]provided on the ceramic substrate 404. A permanent magnet 406 coated with an iron plate 405 is provided above the garnet plate 402. All of these elements are housed by the casing 407 and 408. Other elements such as hollow coils and capacitors may be implemented therein if required. Two ceramic substrates are often laminated.

Such prior art isolators have been made compact following the miniaturization of other microwave elements. For example, a very small isolator having an area of 20 mm×20 mm and a height of 10 mm has been realized, which uses garnet plates of 10 mm in outer diameter and 0.9 mm in thickness, and a permanent magnet of 13 mm in outer diameter and 4 mm in thickness.

Although prior art isolators have been made very compact, they are still much larger than other microwave elements. In particular, they are too high, protruding above surrounding elements.

In view of these circumstances, Nippon Ferrite previously filed a patent application for a lumped constant non-reciprocal circuit element comprising a set of mutually insulated central conductors, only a single garnet plate not more than 0.6 mm in thickness, a ceramic substrate having a central bore and a planar surface with patterned electrodes formed thereon, the set of mutually insulated central conductors being positioned within the central bore, and a permanent magnet positioned proximate the garnet plate for applying a dc magnetic field to the garnet plate, wherein each of the mutually insulated central conductors is folded to wrappingly enclose the garnet plate when received in the central bore of the ceramic substrate, and wherein the substrate is further provided with a plurality of terminals connected to the patterned electrodes to which terminal portions of the central conductor are operatively connected [Japanese Patent Laid-Open No. 63-107203 published May 12, 1988, corresponding to U.S. Pat. No. 4,812,787 issued March 14, 1989].

This lumped constant non-reciprocal circuit element will be described by an example of an isolator referring to FIGS. 9–12.

This lumped constant isolator comprises a circular shielding plate 501, three central conductors 502, a magnetic member 504, insulating sheets 505, an insulator substrate 506, three electrostatic capacitor-forming conductor layers 507, a conductor layer 508 formed on a bottom surface of the insulator substrate 506, a dummy resistor layer 509 and a ground electrode 510.

The three central conductors 502 extend radially from the circular shielding plate 501 and have terminals 503 at their tip ends. The magnetic member 504 is disposed on the shielding plate 501, and a first central conductor 502 is folded. After disposing an insulating sheet 505 thereon, a second central conductor 502 is folded and another insulating sheet 505 is disposed. Finally, a third central conductor 502 is folded to constitute a central conductor means. The insulator substrate 506 is provided with three electrostatic capacitor-forming conductor layers 507, a dummy resistor layer 509 and a ground electrode 510 for the dummy resistor layer 509 on a top surface thereof. The insulator substrate 506 is also provided with a conductor layer 508 over an entire bottom surface thereof. The ground electrode 510 on the top surface and the conductor layer 508 on the bottom surface are electrically connected to each other via a through-hole. The insulator substrate 506 has a central bore for receiving the central conductor means.

The insulator substrate 506 is disposed on a ground base 511, and the central conductor means is disposed in the central bore of the insulator substrate 506. Each of the terminals 503 of the central conductors 502 is connected to each electrostatic capacitor-forming conductor layer 507 formed on the insulator substrate 506 to constitute this lumped constant isolator. Incidentally, a magnet for applying a dc magnetic field to the central conductor means is disposed above the central conductor means.

In this lumped constant isolator, if the dummy resistor layer 509 and the ground electrode 510 are omitted, the isolator can be converted to a lumped constant circulator.

As described above, in each of these lumped constant isolators and lumped constant circulators, the central conductors and the shielding plate are formed integrally. Accordingly, the assembling is conducted by folding the central conductors to wrap the magnetic member. However, when the central conductors are folded, they tend to open due to their resilience, so that insulating sheets inserted between the central conductors are likely to be displaced. This might cause short-circuiting between the central conductors. In addition, the folding of the central conductors is sometimes troublesome. Also, if the central conductors are not folded precisely at predetermined angles, the desired characteristics of the insulator or circulator cannot be achieved.

OBJECT AND SUMMARY OF THE INVENTION

Therefore, it is an object of the present invention to provide a lumped constant non-reciprocal circuit element which can be easily assembled with high precision.

Thus, the lumped constant non-reciprocal circuit element according to the present invention comprises [a) an insulator substrate: [b]a predetermined number of conductor layers formed on a top surface of the insulator substrate for forming electrostatic capacitors; [c]a shielding conductor layer formed on a top surface of the insulator substrate; [d]a conductor layer formed on a bottom surface of the insulator substrate and electrically connected to the shielding conductor layer; [e]a magnetic member disposed on the shielding conductor layer formed on the insulator substrate; [f]a predetermined number of mutually insulated central conductors disposed on the magnetic member such that one end of each central conductor is connected to the shielding conductor layer and the other portion of each central conductor is connected to the electrostatic capacitor-forming conductor layer; and [g]a means for applying a dc magnetic field to the magnetic member.

BRIEF DESCRIPTION OF THE DRAWINGS

FIG. 2 [*b*]is a bottom view of the insulator substrate;

DETAILED DESCRIPTION OF THE PREFERRED EMBODIMENTS

Figure 1:
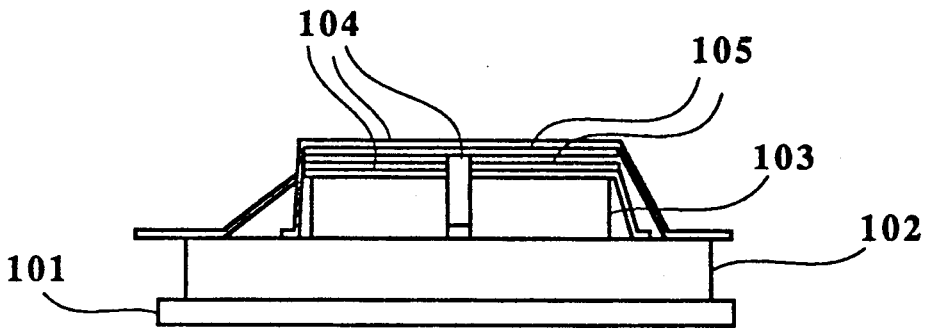
FIG. 1 is a side view of a lumped constant isolator according to a first embodiment of the present invention.

A lumped constant isolator according to a first embodiment of the present invention is shown in FIG. 1. In this embodiment, the lumped constant isolator comprises a ground base 101, an insulator substrate 102 disposed on the ground base 101, a magnetic member 103 disposed on the insulator substrate 102, and three central conductors 104 disposed on the magnetic member 103 such that they are insulated from each other by insulating sheets 105 inserted therebetween. A permanent magnet [not shown]for applying a dc magnetic field to the magnetic member 103 is disposed on the central conductors 104.

Figure 2A:
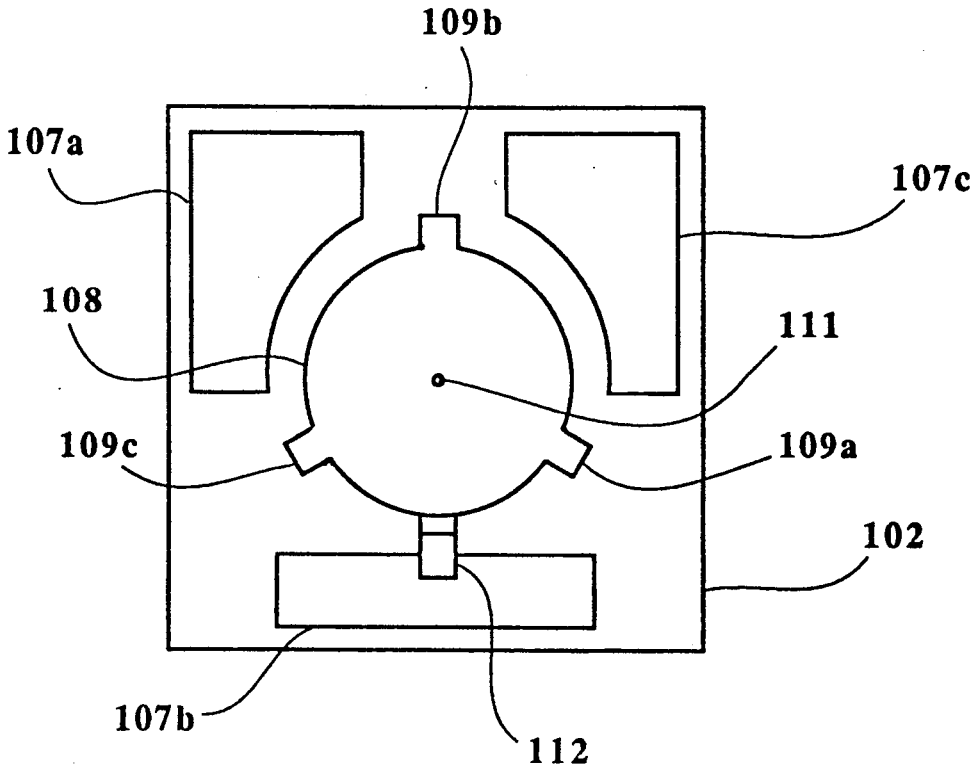
FIG. 2 [*a*]is a plan view of an insulator substrate provided with conductor layers for the isolator of FIG. 1.
Figure 2B:
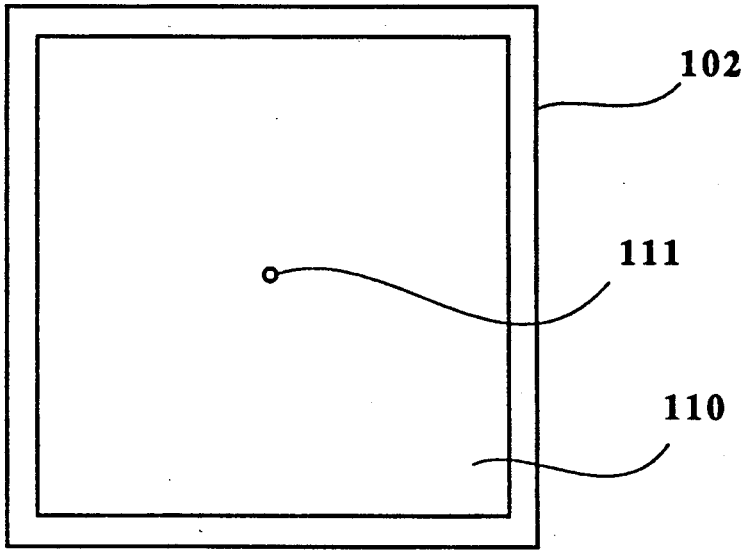
Figure 3A:
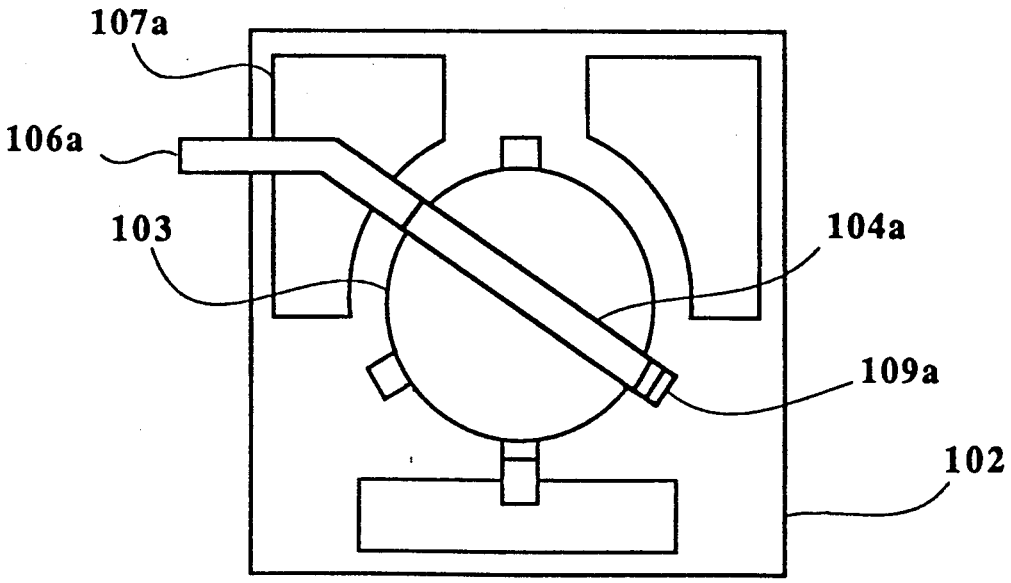
FIGS. 3 [*a*]–[*c*]are schematic views showing the assembling of the isolator of FIG. 1.
Figure 3B:
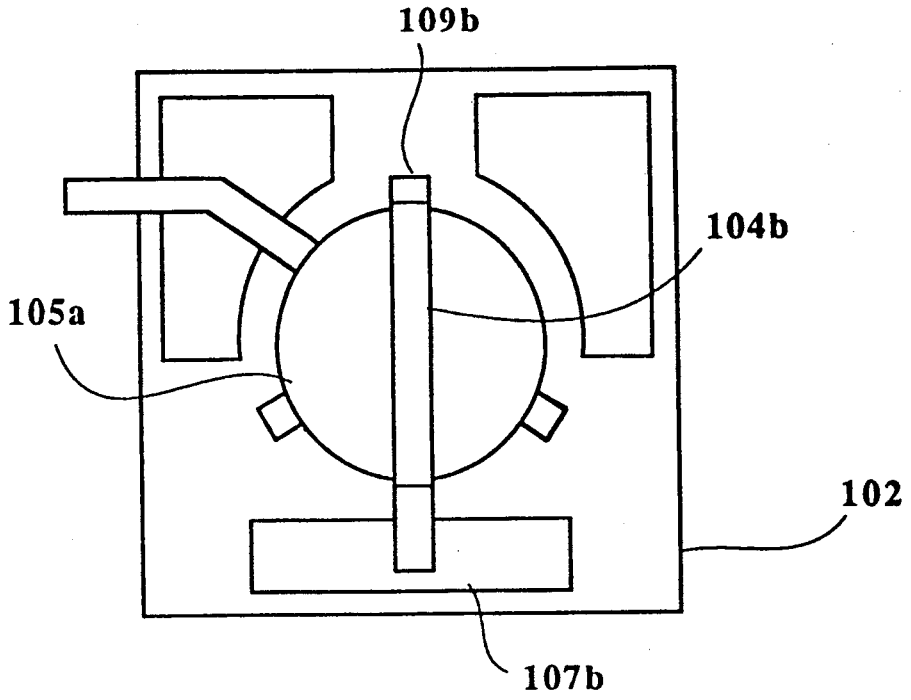
Figure 3C:
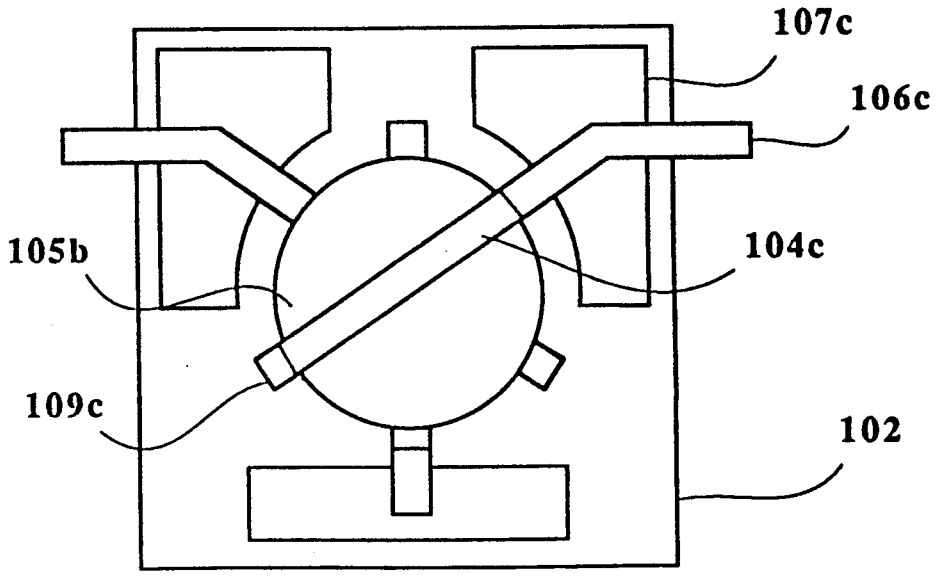

In this embodiment, the insulator substrate 102 is a ceramic substrate of 7 mm×7 mm×0.3 mm [thickness]-having a relative dielectric constant of 170. As shown in FIG. 2 [*a*], the insulator substrate 102 is provided on a top surface thereof with conductor layers 107*a*, 107*b*, 107*c* for forming electrostatic capacitors, a circular shielding conductor layer 108 on which the magnetic member 103 is disposed, and a dummy resistor layer 112 made of $RuO_2$ and connected to both the shielding conductor layer 108 and one of the electrostatic capacitor-forming conductor layers 107*b*. The shielding conductor layer 108 is provided with radial projections 109*a*, 109*b*, 109*c* to which ends of the central conductors 104*a*, 104*b*, 104*c* are connected as depicted in FIGS. 3(*a*)–3(*c*). As shown in FIG. 2 [*b*], this insulator substrate 102 is also provided with a conductor layer 110 over an entire bottom surface thereof, and the conductor layer 110 is connected to the shielding conductor layer 108 via a through-hole 111. The magnetic member 103 is made of garnet ferrite and preferably has a size of 3 mm in diameter and 0.5 mm in thickness. The garnet ferrite typically shows a saturation magnetization [$4\pi Ms$]of 0.1 T.

FIGS. 3 [*a*]–[*c*]show the assembling of this lumped constant isolator. First, the insulator substrate 102 is disposed on the ground base 101 and the magnetic member 103 is disposed on the shielding conductor layer 108 formed on the insulator substrate 102. A first central conductor 104*a* extends over the magnetic member 103 such that one end of the central conductor 104*a* is connected to a first projection 109*a* of the shielding conductor layer 108, and that a portion of the central conductor 104*a* is connected to the electrostatic capacitor-forming conductor layer 107*a* located on the diametrically opposite side of the first projection 109*a*. A tip end of the first central conductor 104*a* extends from the insulator substrate 102, serving as a terminal 106*a*. Next, an insulating sheet 105*a* is disposed on the first central conductor 104*a* and a second central conductor 104*b* is disposed thereon such that one end of the second central conductor 104*b* is connected to a second projection 109*b* of the circular shielding conductor layer 108, and a portion of the second central conductor 104*b* is connected to an electrostatic capacitor-forming conductor layer 107*b*. Further, an insulating sheet 105*b* is disposed and then a third central conductor 104*c* is disposed thereon such that the third central conductor 104*c* extends over the insulating sheet 105*b* with one end thereof connected to a third projection 109*c* of the circular shielding conductor layer 108, with a portion thereof connected to a third electrostatic capacitor-forming conductor layer 107*c* and with a tip end thereof extending from the insulator substrate 102 for serving as a terminal 106*c*. The lumped constant isolator is constituted by disposing a permanent magnet for applying a dc magnetic field to the magnetic member 103 above the third central conductor 104*c*.

Figure 4:
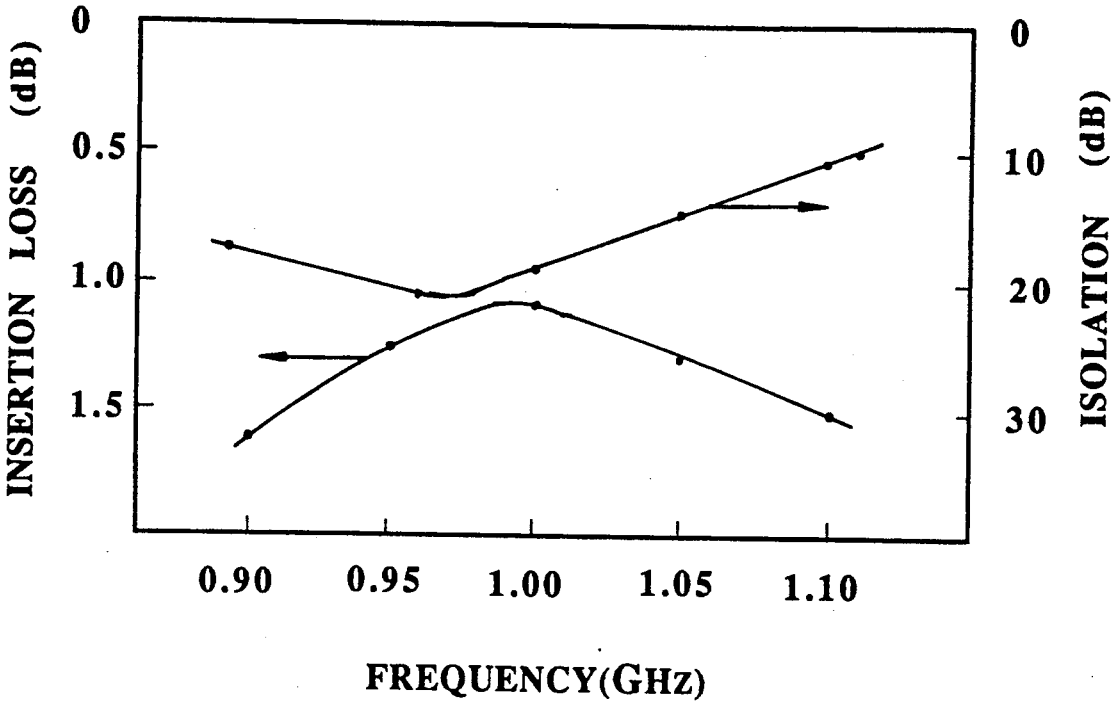
FIG. 4 is a graph showing the relations between insertion loss and isolation and frequency in the lumped constant isolator according to a first embodiment of the present invention.

The isolation and insertion loss characteristics of the lumped constant isolator according to this embodiment are shown in FIG. 4. It is clear from FIG. 4 that the lumped constant isolator of this embodiment is on a satisfactory level for practical purposes.

Figure 5:
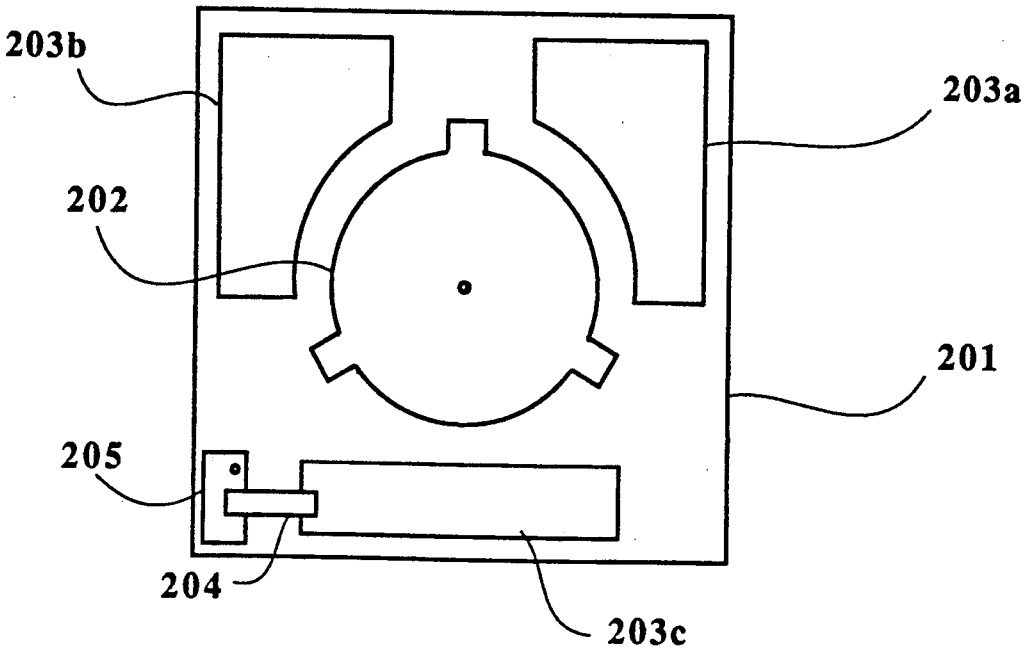
FIG. 5 is a plan view showing an insulator substrate for a lumped constant isolator according to a second embodiment of the present invention.

FIG. 5 shows a lumped constant isolator according to a second embodiment of the present invention. In this embodiment, an insulator substrate 201 is provided with a shielding conductor layer 202 in its center, and three electrostatic capacitor-forming conductor layers 203*a*, 203*b*, 203*c* are formed around the shielding conductor layer 202. One electrostatic capacitor-forming conductor layer 203*c* is connected to a dummy resistor layer [$RuO_2$]204 which is in turn connected to a ground electrode 205 formed on the insulator substrate 201. The insulator substrate 201 is also formed with a conductor layer on substantially the entire bottom surface thereof, and the conductor layer on the bottom surface is connected to the shielding conductor layer 202 and the ground electrode 205 via a through-hole. This insulator substrate 201 is used to construct a lumped constant isolator having the same structure as in the first embodiment.

Figure 6:
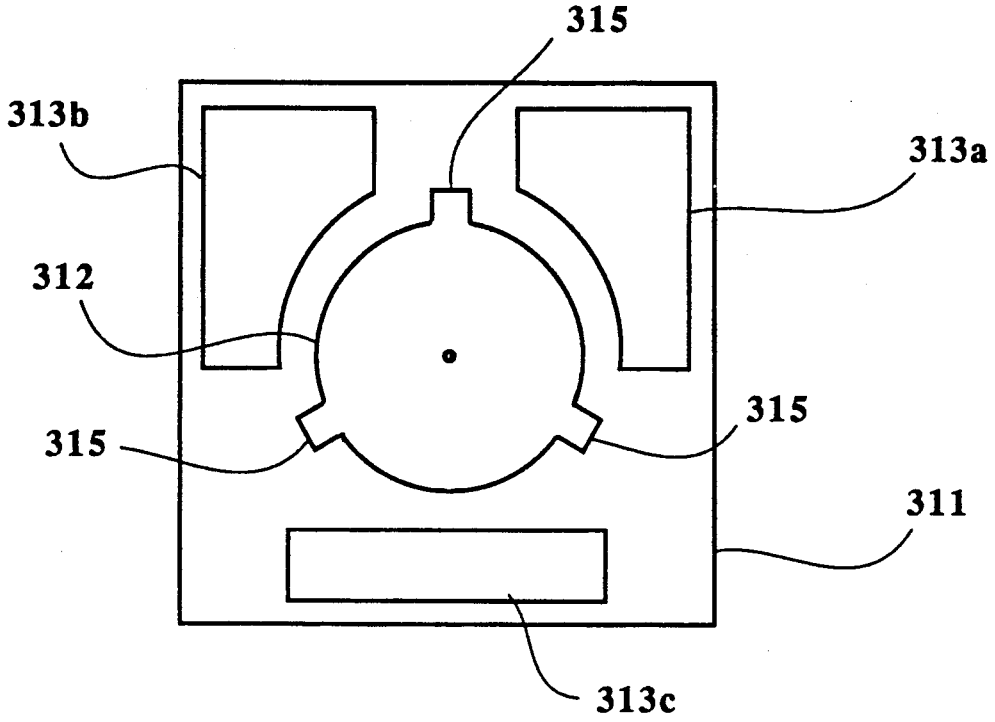
FIG. 6 is a plan view showing an insulator substrate for a lumped constant circulator according to a third embodiment of the present invention.
Figure 7:
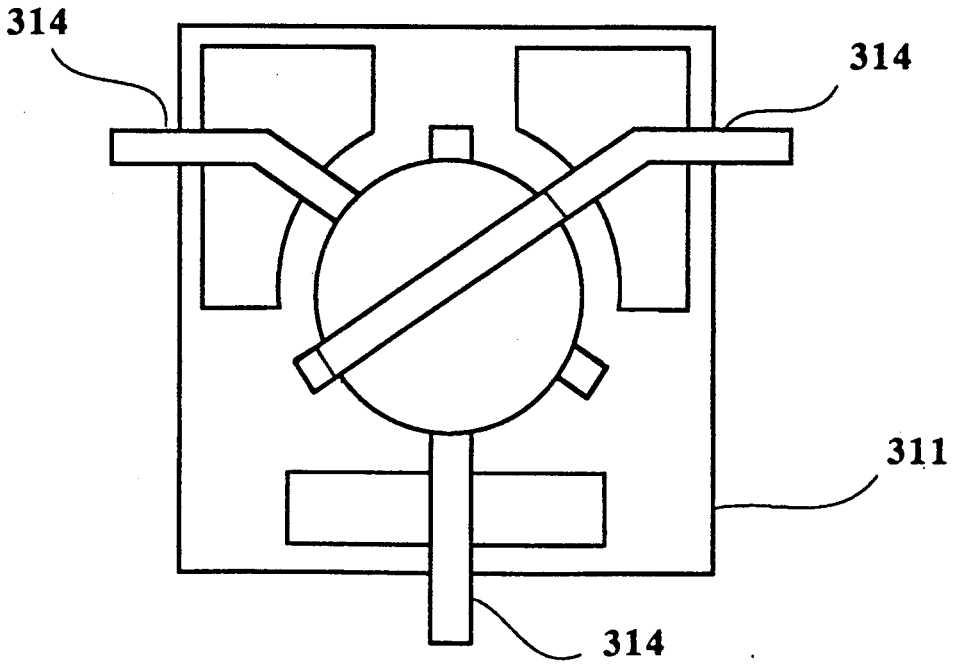
FIG. 7 is a plan view showing the assembling of a lumped constant circulator by using the insulator substrate of FIG. 6.
Figure 8:
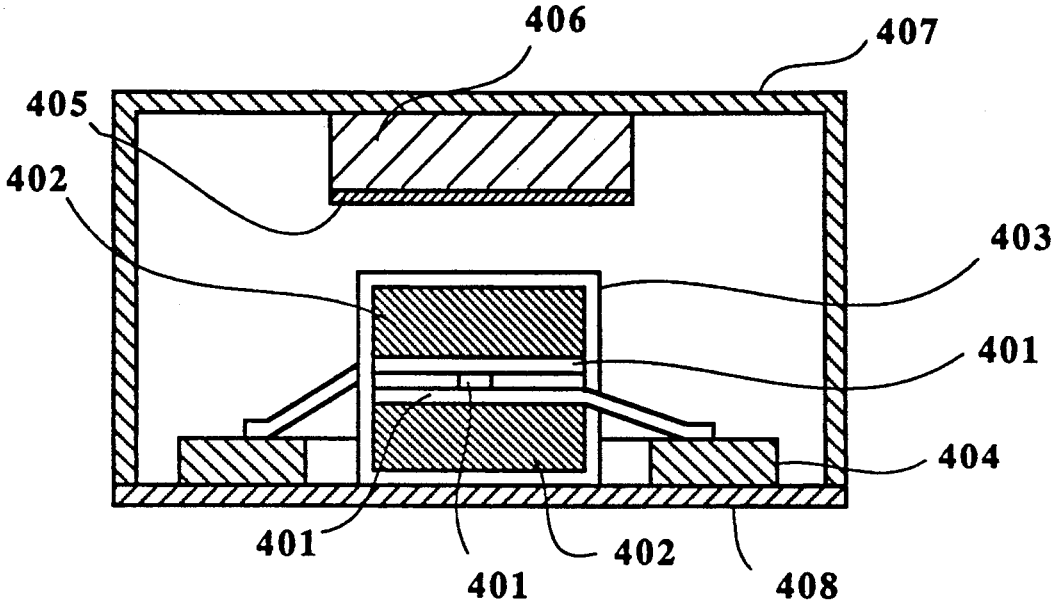
FIG.8 (PRIOR ART)
FIG. 8 is a cross-sectional view showing a conventional lumped constant isolator.
Figure 12:
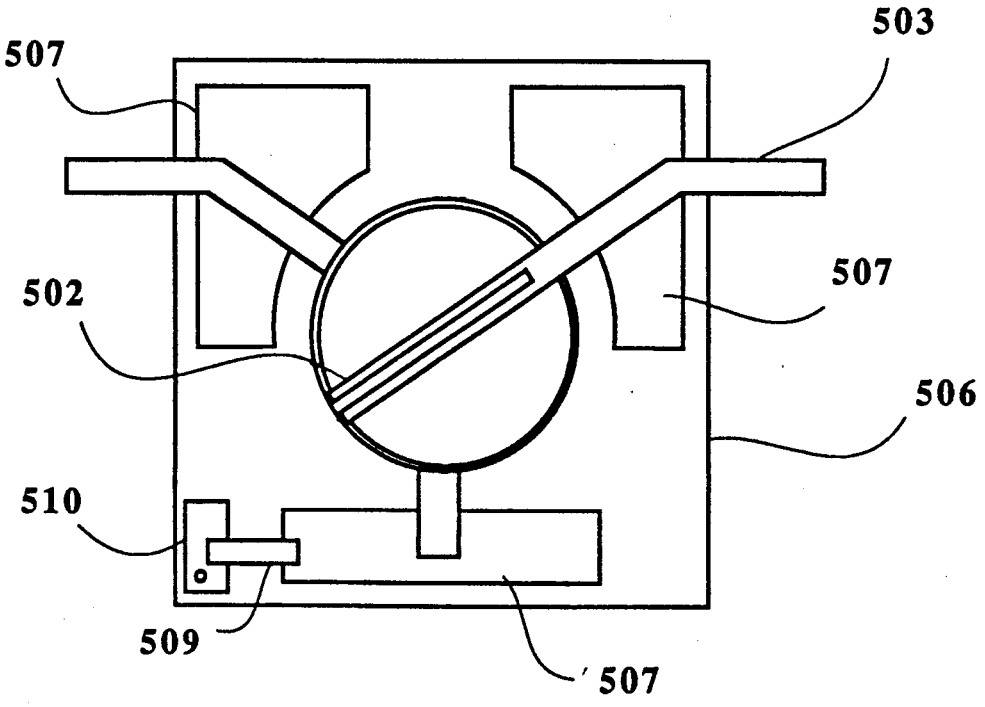
FIG.12 (PRIOR ART)
FIG. 12 is a plan view showing an insulator substrate provided with conductor layers and a central conductor for the lumped constant isolator of FIG. 9.
Figure 9:
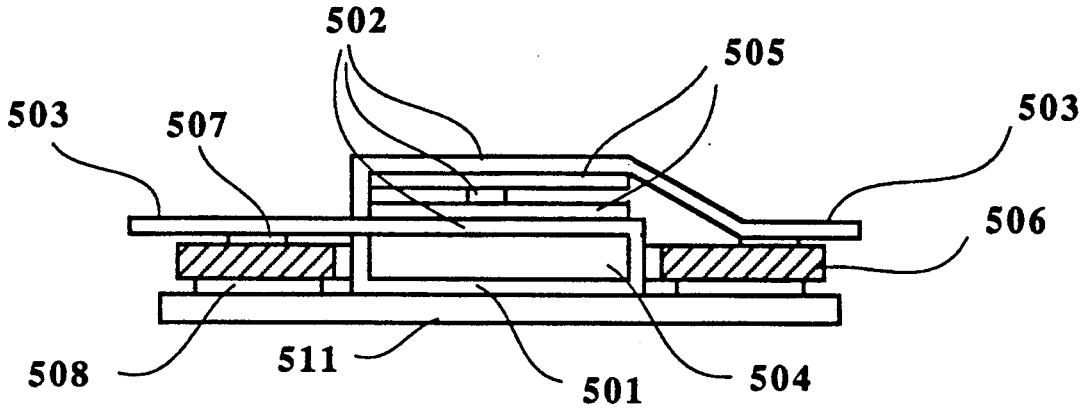
FIG.9 (PRIOR ART)
FIG. 9 is a cross-sectional view showing a lumped constant isolator described in Japanese Patent Laid-Open No. 63-107203.
Figure 10:
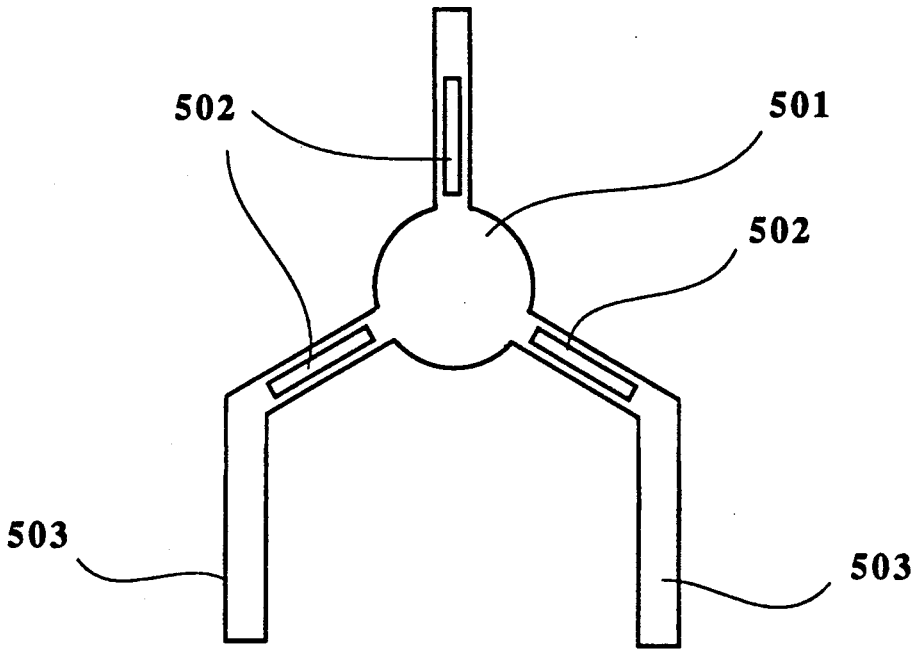
FIG.10 (PRIOR ART)
FIG. 10 is a plan view showing central conductors to be assembled in the lumped constant isolator of FIG. 9.
Figure 11:
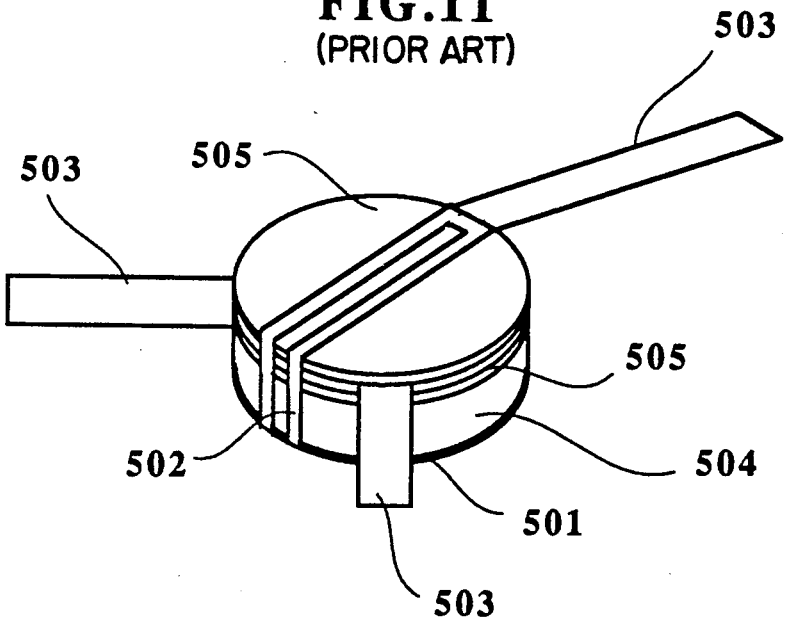
FIG.11 (PRIOR ART)
FIG. 11 is a perspective view showing a central conductor means in the lumped constant isolator of FIG. 9.

FIGS. 6 and 7 show a lumped constant circulator according to a third embodiment of the present invention. In this embodiment, the lumped constant circulator has a substantially the same structure as in the above embodiments. Specifically speaking, an insulator substrate 311 is provided with a shielding conductor layer 312 in a center thereof, and three conductor layers 313*a*, 313*b*, 313*c* for constituting electrostatic capacitors are formed around the shielding disposed on the shielding conductor layer 312 formed on this insulator substrate 311, and three central conductors 314 are disposed on the garnet magnetic member, such that the central conductors 314 are mutually insulated by insulating sheets. The central conductors 314 are placed in the same manner as in the above embodiments except that all central conductors extend from the substrate 311 to serve as terminals. Namely, one end of a central conductor 314 is connected to one projection 315 of the shielding conductor layer 312 and a portion of the central conductor 314 is connected to one electrostatic capacitor-forming conductor layer 313, and further a tip end of the central conductor 314 extends from the substrate 311 to serve as a terminal. The same is true of the remaining two central conductors. A permanent magnet for applying a dc magnetic field to the garnet magnetic member is disposed above the magnetic member to constitute a lumped constant circulator.

In these embodiments, each central conductor can be electrically connected to the shielding conductor layer and the electrostatic capacitance-providing conductor layer on the same plane, facilitating the assembling of the lumped constant circulator. Also, insulating sheets are fixed by the central conductors, thereby preventing the short-circuiting between the central conductors. In addition, the directions of the central conductors can be set precisely, resulting in lumped constant non-reciprocal circuit elements with stable characteristics.

As described above in detail, the lumped constant non-reciprocal circuit element of the present invention can be assembled easily and even can be subjected to automatic assembling. In addition, the short-circuiting between the central conductors can be completely prevented. Therefore, they can be used as highly reliable lumped constant isolators or circulators.

The present invention has been described referring to the attached drawings, but it should be noted that any modifications may be made unless they deviate from the scope of the present invention defined in the claims attached hereto.

What is claimed is:

1. A lumped constant non-reciprocal circuit element comprising:

(a) an insulator substrate;

(b) a ground layer formed on a bottom surface of said insulator substrate;

(c) a predetermined number of conductor layers formed on a top surface of said insulator substrate for forming electrostatic capacitors with said ground layer;

(d) a shielding conductor layer formed on said top surface of said insulator substrate and conductively connected to said ground layer;

(e) a magnetic ferrite member disposed on said shielding conductor layer formed on said insulator substrate;

(f) the same predetermined number as in (c) of mutually insulated central conductors disposed on said magnetic ferrite member such that one end of each central conductor is connected to said shielding conductor layer and the other end of each central conductor is connected to each electrostatic capacitor-forming conductor layer; and (g) a means for applying a dc magnetic field to said magnetic ferrite member.

2. The lumped constant non-reciprocal circuit element according to claim 1, wherein said element functions as a lumped constant circulator.

3. The lumped constant non-reciprocal circuit element according to claim 1, further comprising a dummy resistor layer having one end connected to one of said electrostatic capacitor-forming conductor layers and the other end connected to said ground layer, whereby said element functions as a lumped constant isolator.

4. The lumped constant non-reciprocal circuit element according to claim 1, wherein said magnetic ferrite member has a disc shape, and said shielding conductor layer has substantially the same shape as said magnetic ferrite member and is provided with the same predetermined number as in (c) of radial projections, one end of a respective one of said central conductor layers being connected to each of said radial projections.

* * * * *